US010569578B2

(12) United States Patent
Washizawa et al.

(10) Patent No.: US 10,569,578 B2
(45) Date of Patent: Feb. 25, 2020

(54) PRINTING APPARATUS

(71) Applicant: SEIKO EPSON CORPORATION, Tokyo (JP)

(72) Inventors: Takehito Washizawa, Shiojiri (JP); Hiroki Aoki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/230,642

(22) Filed: Dec. 21, 2018

(65) Prior Publication Data

US 2019/0193435 A1 Jun. 27, 2019

(30) Foreign Application Priority Data

Dec. 22, 2017 (JP) ..... 2017-245965

(51) Int. Cl.
*B41J 15/04* (2006.01)
*B41J 11/00* (2006.01)

(52) U.S. Cl.
CPC ..... *B41J 15/046* (2013.01); *B41J 11/0025* (2013.01)

(58) Field of Classification Search
CPC ..... B41J 15/046; B41J 11/0025
See application file for complete search history.

(56) References Cited

U.S. PATENT DOCUMENTS 8,662,771 B2 * 3/2014 Kawaguchi ..... B26D 1/085 400/621
9,308,745 B2 * 4/2016 Oguchi ..... B41J 2/175

FOREIGN PATENT DOCUMENTS

JP 2004-230839 A 8/2004
JP 2011-016268 A 1/2011
JP 2016-068419 A 5/2016

* cited by examiner

*Primary Examiner* — Lamson D Nguyen
(74) *Attorney, Agent, or Firm* — Workman Nydegger

(57) ABSTRACT

A printing apparatus includes a platen including a first guide rail and a second guide rail mutually parallel in a width direction that intersects a transport direction of a medium; an edge holder including a plate-shaped member that covers an end portion of the medium in the width direction, a first engaging portion that engages with the first guide rail, and a second engaging portion that engages with the second guide rail; and a changing portion that is provided on the first engaging portion side and is for changing a position of the plate-shaped member in the width direction. A space in the transport direction formed between the first engaging portion and the first guide rail is narrower than a space in the transport direction formed between the second engaging portion and the second guide rail.

8 Claims, 6 Drawing Sheets

PRINTING APPARATUS

BACKGROUND

1. Technical Field

The present invention relates to a printing apparatus.

2. Related Art

There have been known printing apparatuses of an ink-jet type configured to discharge ink from a discharging head and print an image or the like on a medium transported in a transport direction. In a printing apparatus that uses a long medium, the printing apparatus may include an edge holder that suppresses the medium from floating upward from a platen that supports the medium. In JP 2016-68419 A, for example, there is disclosed a printing apparatus that includes a pressing portion (edge holder) capable of switching between a pressed state that allows an end portion of the medium in a width direction intersecting the transport direction to be pressed against a medium support portion (platen), and a non-pressed state that does not allow the end portion of the medium to be pressed against the medium support portion, and a gripping portion (changing portion) that moves the pressing portion in the width direction.

The platen of the printing apparatus described in JP 2016-68419 A is provided with a guide rail that guides the edge holder in the width direction in accordance with the width of the medium, and the edge holder is provided with an engaging portion that engages with the guide rail. Nevertheless, the guide rail is provided in a position separated from the changing portion in the transport direction of the medium and thus, when the user grips the changing portion and attempts to slide (move) the edge holder in the width direction, the edge holder may rotate in an arc direction with the engaging portion as a fulcrum and the changing portion as a force point, preventing the edge holder from moving. That is, the problem arises that the edge holder is difficult to slide in a smooth manner.

SUMMARY

Some aspects of the invention address at least some of the above-described issues, and can be realized as the following modes or application examples.

Application Example 1

A printing apparatus according to an aspect of the present invention includes a platen including a first guide rail and a second guide rail mutually parallel in a width direction that intersects a transport direction of a medium, an edge holder including a plate-shaped member configured to cover an end portion of the medium in the width direction, a first engaging portion configured to engage with the first guide rail, and a second engaging portion configured to engage with the second guide rail. A space in the transport direction formed between the first engaging portion and the first guide rail is narrower than a space in the transport direction formed between the second engaging portion and the second guide rail, and a changing portion that is provided on the first engaging portion side and is configured to change a position of the plate-shaped member in the width direction.

According to the application example, the printing apparatus includes the platen including the first and second guide rails, and the edge holder including the plate-shaped member that covers the end portion of the medium, and the first and second engaging portions configured to engage with the first and second guide rails. The space in the transport direction formed between the first engaging portion and the first guide rail is narrower than the space in the transport direction formed between the second engaging portion and the second guide rail. Further, the changing portion configured to change the position of the plate-shaped member in the width direction is provided on the first engaging portion side. That is, when the edge holder is slid, the space between the first guide rail and the first engaging portion serving as a fulcrum for rotating the edge holder is narrow, and the distance between the first engaging portion and the changing portion serving as a force point that rotates the edge holder is short. When the position of the edge holder is changed, the first engaging portion slides relative to the first guide rail, and thus the second engaging portion does not catch on the second guide rail. Further, the distance between the fulcrum and the force point is short, suppressing rotation of the edge holder and making it possible to smoothly slide the edge holder.

Application Example 2

In the printing apparatus described in the application example above, it is preferable that the changing portion is configured to switch the second engaging portion and the second guide rail between a contact state and a separated state by moving a position of the first engaging portion relative to the plate-shaped member in the transport direction, and changing a distance between the first engaging portion and the second engaging portion.

According to the application example, the changing portion sets the second engaging portion and the second guide rail to a contact state or a separated state by changing the distance between the first engaging portion and the second engaging portion. With the second engaging portion and the second guide rail set to a contact state, it is possible to restrict the movement of the edge holder relative to the platen. Further, with the second engaging portion and the second guide rail set to a separated state, it is possible to slide the edge holder relative to the platen.

Application Example 3

In the printing apparatus described in the application example above, it is preferable that the changing portion and the first engaging portion are connected and formed using a same member.

According to the application example, the changing portion and the first engaging portion are connected and thus, when the edge holder is slid, the distance between the fulcrum (first engaging portion) for rotating the edge holder and the force point (changing portion) that rotates the edge holder is also short. Thus, the rotation of the edge holder is further suppressed, making it possible to smoothly slide the edge holder. Further, the changing portion and the first engaging portion are formed using the same member, making it possible to simplify the configuration.

Application Example 4

In the printing apparatus described in the application example above, it is preferable that the second engaging portion that comes into contact with the second guide rail has a wedge shape.

According to the application example, the second engaging portion has a wedge shape. Specifically, the second engaging portion includes a contact surface having a wedge shape that, with the second engaging portion brought into contact with the second guide rail, causes a force in a direction of embedment into the platen to act on the second engaging portion. As a result, it is possible to press the medium against the platen with the plate-shaped member by bringing the second guide rail and the second engaging portion into a contact state.

Application Example 5

In the printing apparatus described in the application example above, it is preferable that the changing portion includes an elastic member, and the contact state is maintained by an elastic force of the elastic member.

According to the application example, the changing portion includes the elastic member, and the contact state is maintained by the elastic force of the elastic member, making it possible to continually press the medium against the platen.

Application Example 6

In the printing apparatus described in the application example above, it is preferable that the changing portion includes a magnet, and the contact state is maintained by a magnetic force of the magnet.

According to the application example, the changing portion includes the magnet, and the contact state is maintained by the magnetic force of the magnet, making it possible to continually press the medium against the platen.

Application Example 7

In the printing apparatus described in the application example above, it is preferable that the changing portion includes a screw, and the contact state is maintained by the screw.

According to the application example, the changing portion includes the screw, and the contact state is maintained by the screw, making it possible to continually press the medium against the platen.

Application Example 8

In the printing apparatus described in the application example above, it is preferable that the changing portion includes a motor, and the contact state is maintained by a driving force of the motor.

According to the application example, the changing portion includes the motor, and the contact state is maintained by the driving force of the motor, making it possible to continually press the medium against the platen.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplary embodiments of the present invention will be described below with reference to the drawings. Note that, in each of the figures below, to illustrate each of members and the like in a recognizable size, each of the members and the like is illustrated to a scale different from an actual scale.

Furthermore, in FIGS. 1 to 9, for simplicity, an X-axis, a Y-axis, and a Z-axis are illustrated as three axes perpendicular to one another, and a leading end side of an arrow indicating an axial direction is referred to as a "+ side", and a trailing end side is referred to as a "– side". Furthermore, a direction parallel to the X-axis is referred to as an "X-axis direction", a direction parallel to the Y-axis is referred to as a "Y-axis direction", and a direction parallel to the Z-axis is referred to as a "Z-axis direction".

Exemplary Embodiments

Firstly, a configuration of a printing apparatus will be described. The printing apparatus is, for example, an ink jet-type printer. In the exemplary embodiment, a large format printer (LFP) that handles long media will be described as a configuration example of the printing apparatus.

Figure 1:
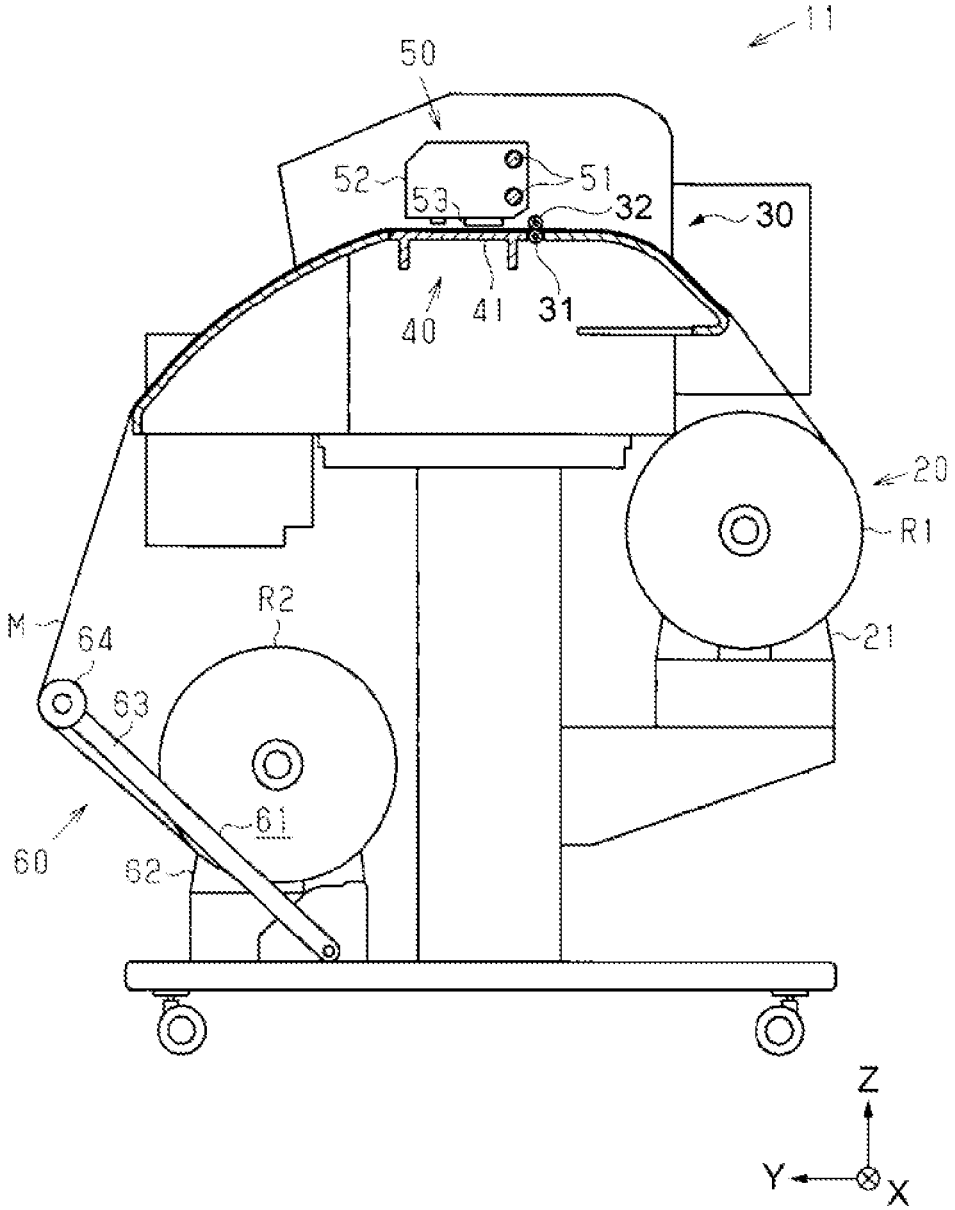
FIG. 1 is a cross-sectional view illustrating a schematic configuration of a printing apparatus according to an exemplary embodiment.
Figure 2:
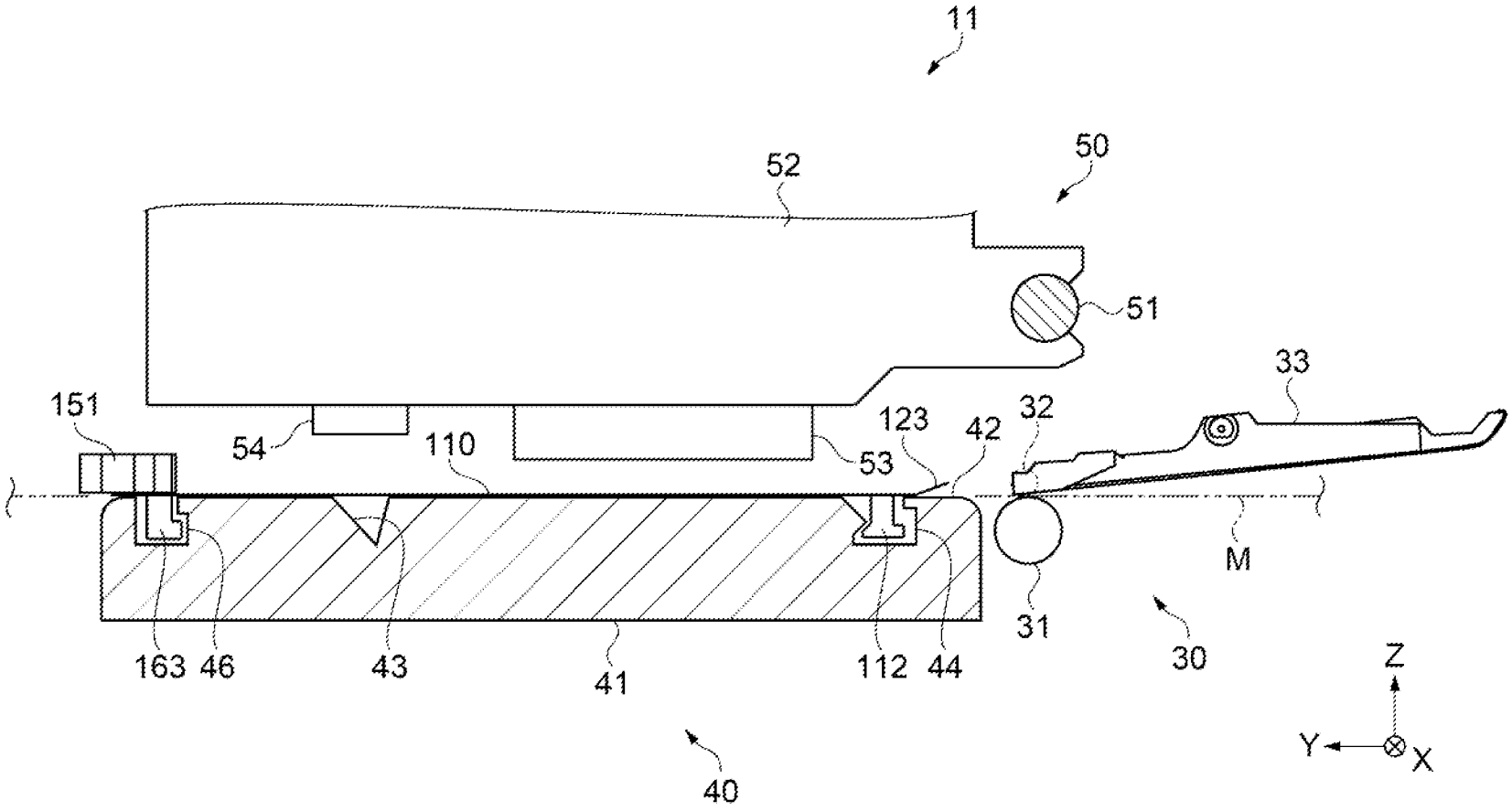
FIG. 2 is a cross-sectional view illustrating a guiding portion and a printing portion, enlarged.
Figure 3:
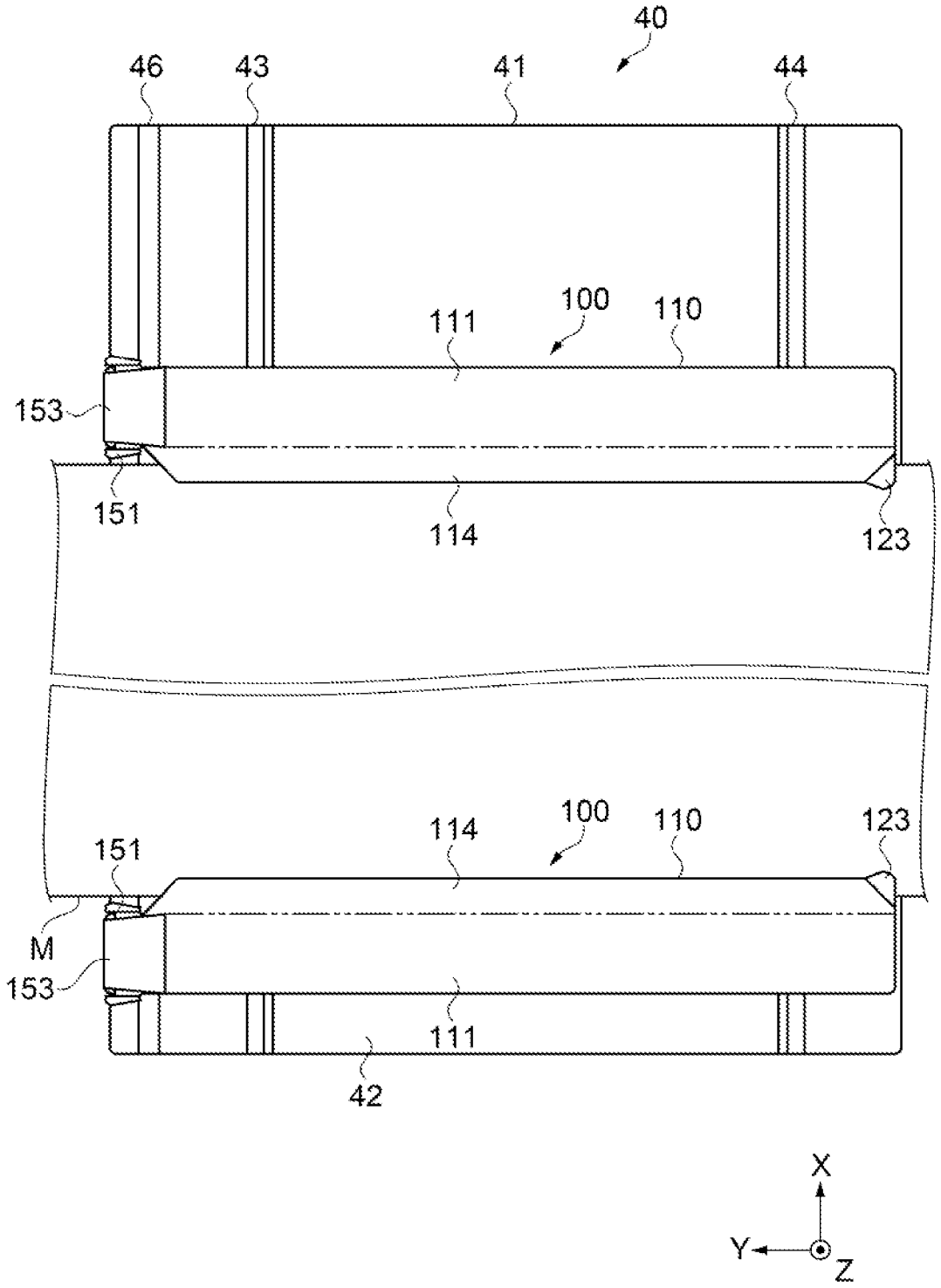
FIG. 3 is a plan view illustrating a configuration of a platen and an edge holder.

FIG. 1 is a cross-sectional view illustrating a schematic configuration of the printing apparatus. FIG. 2 is a cross-sectional view illustrating a guiding portion and a printing portion, enlarged. FIG. 3 is a plan view illustrating a configuration of a platen and an edge holder. As illustrated in FIG. 1, a printing apparatus 11 is a roll-to-roll type, and includes a transporting portion 30 that transports a medium M, a guiding portion 40 that guides the medium M to a printing portion 50, and the printing portion 50 that discharges ink in a predetermined region of the medium M and prints images, characters, and the like. Note that, in the exemplary embodiment, an up-down direction along a gravity direction is the Z-axis direction, a direction in which the medium M is transported in the printing portion 50 is the Y-axis direction, and a width direction of the medium M is the X-axis direction.

The transporting portion 30 includes a feeding portion 20 that feeds the medium M of a roll type to the printing portion 50, and a winding portion 60 that winds the medium M printed and fed by the printing portion 50. Further, the transporting portion 30 includes a transport roller 31 and a driven roller 32 that transport the medium M in the transport direction while on a transport path between the feeding portion 20 and the winding portion 60.

The transport roller 31 forms a substantially cylindrical shape long in the width direction (X-axis direction), and rotates using the X-axis direction as a rotating axis direction by the drive of a driving motor (not illustrated). The driven roller 32 is rotatably supported on a medium pressing plate 33, and presses the medium M against the transport roller 31. Further, the medium pressing plate 33 is rockably supported using the X-axis direction serving as the rotating axis direction, and changes a position of the driven roller 32 in the Z-axis direction in accordance with a thickness of the medium M transported. The medium M is sandwiched by the transport roller 31 and the driven roller 32, and is transported in the transport direction (the Y-axis direction in the printing portion 50) with the rotational driving of the transport roller 31. While the transporting portion 30 illustrated in FIG. 1 is an example with one transport roller 31, a plurality of transport rollers may be provided.

The feeding portion 20 is disposed on an upstream side of the transport roller 31 in the transport direction. The feeding portion 20 includes a retaining portion 21. This retaining portion 21 retains a roll body R1 of the medium M that is unused and wound into a cylindrical shape. The roll body R1 is replaceably mounted on the retaining portion 21, allowing replacement with a plurality of sizes having different widths (lengths in the X-axis direction) and windings of the medium M. The roll body R1 is rotated counterclockwise in FIG. 1 by a driving force of a feeding motor (not illustrated), unwinding and feeding the medium M from the roll body R1 to the printing portion 50.

The winding portion 20 is disposed on a downstream side of the transport roller 31 in the transport direction. The medium M printed by the printing portion 50 is wound into a cylindrical shape onto the winding portion 60, forming a roll body R2. The winding portion 60 includes a pair of holders 62 that hold a core having a cylindrical shape for winding the medium M and forming the roll body R2, and a tension imparting mechanism 61 that imparts tension to the medium M. The tension imparting mechanism 61 includes an arm member 63 that is rockably supported, and a tension roller 64 rotatably supported on a leading end portion of the arm member 63.

In a state in which the tension imparting mechanism 61 presses the tension roller 64, applying tension to the medium M, the core held by the pair of holders 62 is rotated counterclockwise in FIG. 1 by a dynamic force of a winding motor (not illustrated), causing the medium M to wind around the core and form the roll body R2. Note that, in the printing apparatus 11 of the exemplary embodiment, the medium M can be discharged without being wound. For example, the medium M after printing may be housed in a discharge basket (not illustrated) attached in place of the winding portion 60.

The printing portion 50 includes a guide shaft 51 that extends in the width direction (X-axis direction), a carriage 52 supported on the guide shaft 51, a printing head 53 configured to discharge ink onto the medium M, and an optical sensor 54 configured to detect a length of the medium M in the width direction.

The carriage 52 reciprocates in the X-axis direction along the guide shaft 51 by the driving of a carriage motor (not illustrated). The printing head 53 is retained vertically downward (– side in the Z-axis direction) from the carriage 52 so that the printing head 53 can face the transported medium M on a platen 41. Then, when the carriage 52 reciprocates in the X-axis direction, the printing head 53 discharges ink at an appropriate timing, forming characters and images on the medium M. Note that the exemplary embodiment illustrates, as the printing head 53, a serial-head type printing head, which is retained by the reciprocating carriage 52 and which discharges the ink while moving in the width direction (X-axis direction) of the medium M. The printing head 53, however, may be a line head-type printing head, which extends in the X-axis direction and is fixed in place.

The optical sensor 54 is retained vertically downward from the carriage 52 so that the optical sensor 54 can face a detection groove 43 of the platen 41. Then, the optical sensor 54 detects the presence or absence of the medium M on the detection groove 43 in accordance with a reflection intensity of an irradiated light, that is, in accordance with a difference in reflection intensity between when light is irradiated on the medium M and when light is irradiated on the detection groove 43. Thus, a position of an end portion of the medium M in the width direction is detected.

The guiding portion 40 includes the platen 41 that supports the transported medium M from below in the Z-axis direction, and an edge holder 100 that engages with the platen 41. The platen 41 forms a substantially rectangular plate shape long in the width direction (X-axis direction). A surface of the platen 41 facing the printing portion 50 is a support surface 42 that comes into contact with a back surface opposite a printing surface of the medium M, and thus supports the medium M. A first guide rail 46 and a second guide rail 44 parallel to each other in the width direction intersecting the transport direction of the medium M are provided on the support surface 42 of the platen 41. The first guide rail 46 is positioned on a downstream side of the second guide rail 44 in the transport direction (Y-axis direction). Further, the detection groove 43 parallel with the first and the second guide rails 46, 44 is provided between the first guide rail 46 and the second guide rail 44.

Figure 4:
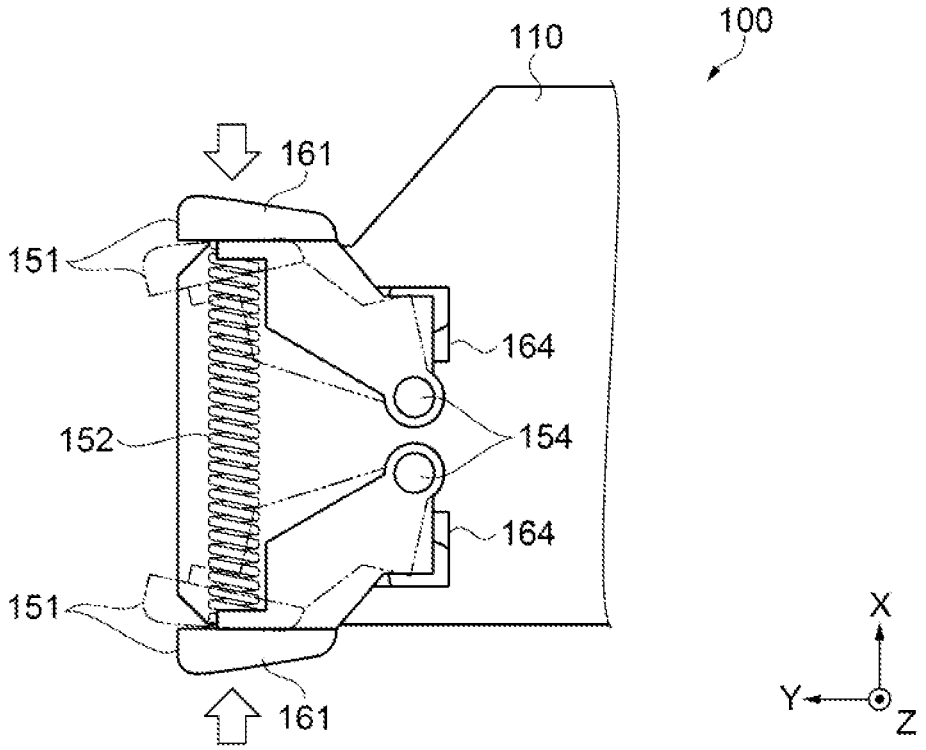
FIG. 4 is a plan view illustrating a configuration of a front face side of a changing portion.
Figure 5:
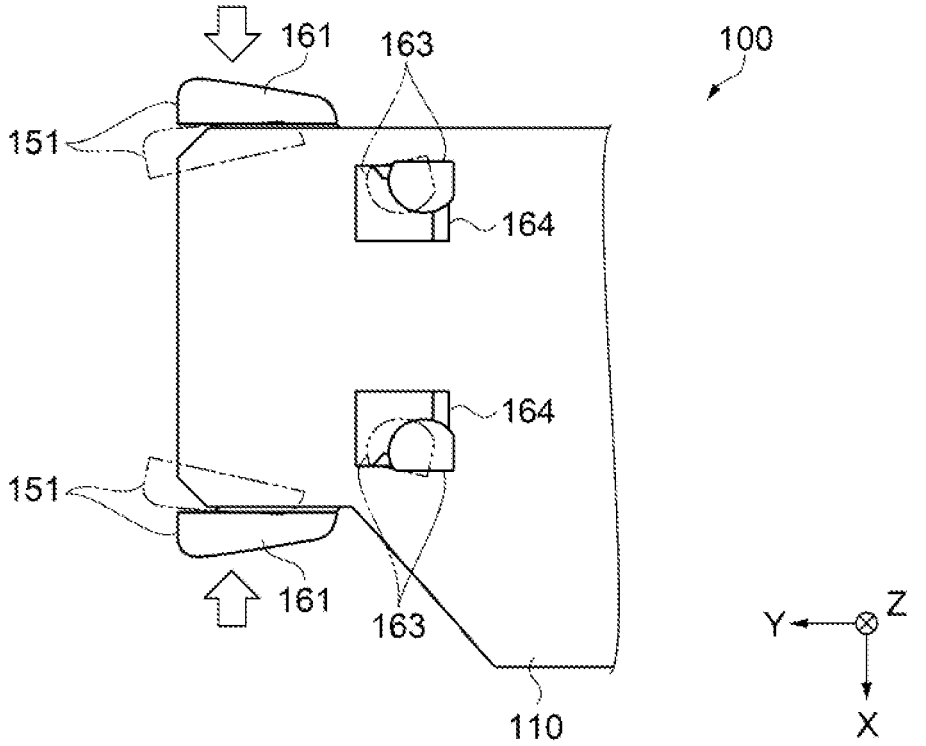
FIG. 5 is a plan view illustrating a configuration of a rear face side of the changing portion.
Figure 6:
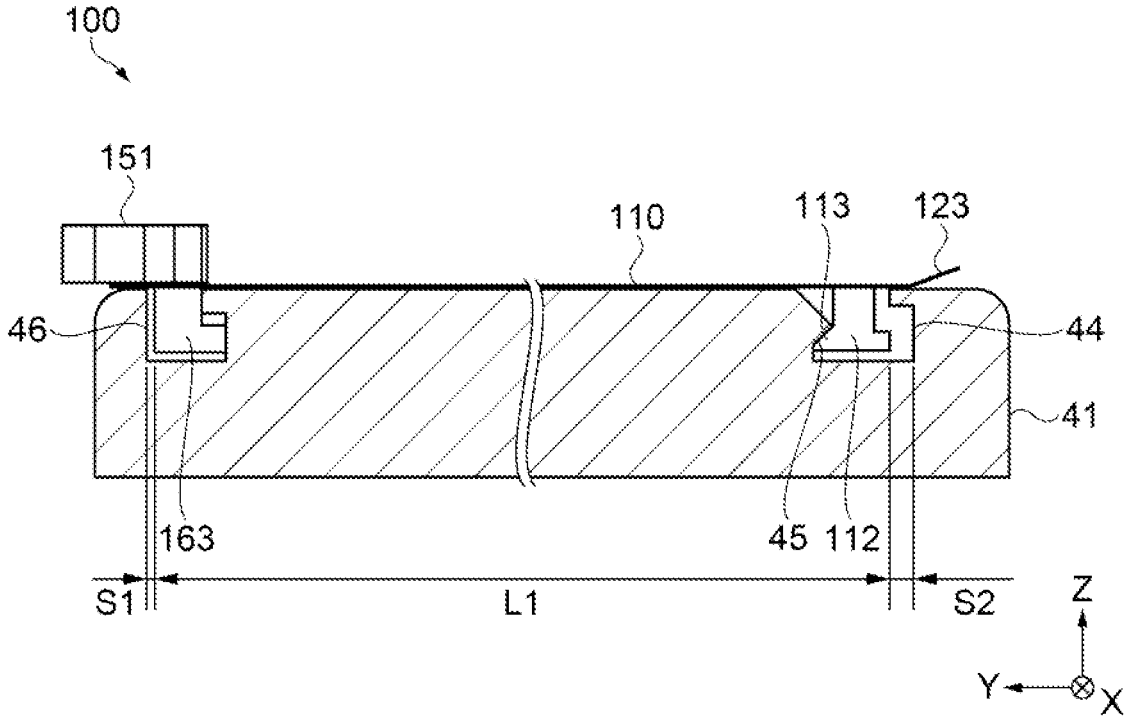
FIG. 6 is a diagram for explaining the edge holder in a contact state.
Figure 7:
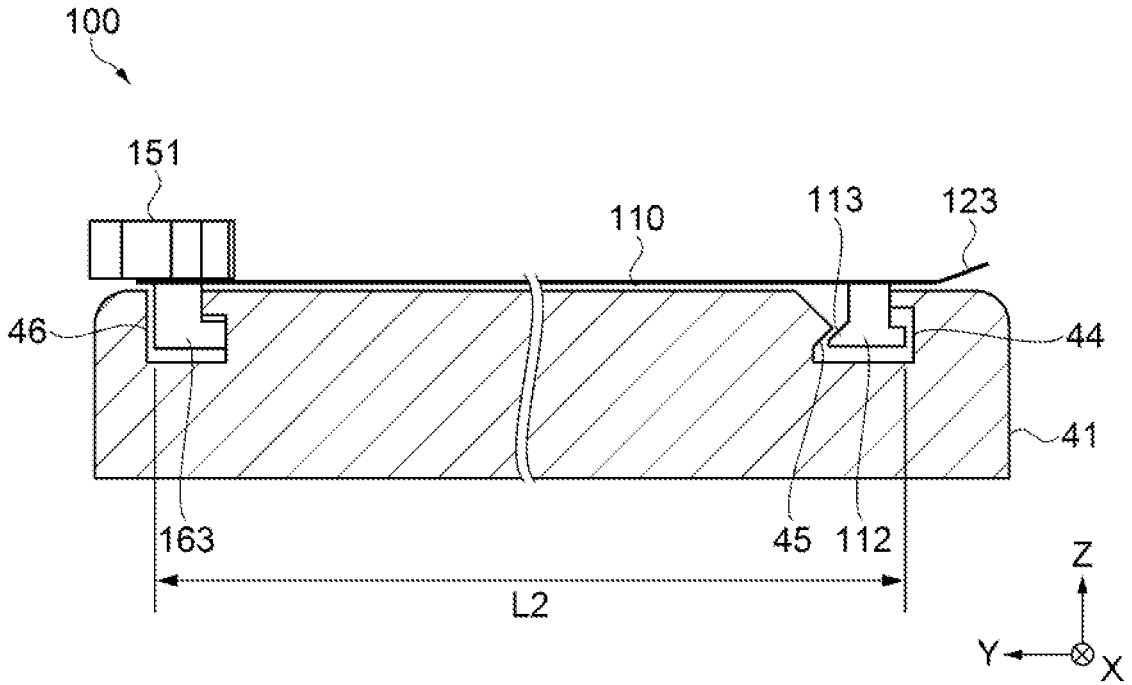
FIG. 7 is a diagram for explaining the edge holder in a separated state.

FIG. 4 is a plan view illustrating the configuration of a front surface side of a changing portion. FIG. 5 is a plan view illustrating the configuration of a rear surface side of the changing portion. FIG. 6 is a diagram for explaining the edge holder in a contact state. FIG. 7 is a diagram for explaining the edge holder in a separated state. Next, the configuration of the edge holder 100 that engages with the platen 41 will be described with reference to FIGS. 3 to 7. Note that, in FIG. 4, a cover member 153 (refer to FIG. 3) configured to cover a portion of a changing portion 151 is illustrated as if transparent. Further, in FIGS. 4 and 5, directions in which the changing portion 151 moves are indicated by the arrows, and positions of the changing portion 151 and the first engaging portion 163 after movement are indicated by the two-dot chain lines.

The edge holder 100 includes a plate-shaped member 110 that covers an end portion of the medium M in the width direction, a first engaging portion 163 that engages with the first guide rail 46, and a second engaging portion 112 that engages with the second guide rail 44. The edge holder 100 is mounted on the support surface 42 of the platen 41, and includes the changing portion 151 for changing the position of the plate-shaped member 100 in the width direction on the first engaging portion 163 side. Note that, in the description below, the side of the plate-shaped member 110 facing the printing portion 50 is referred to as a "front surface side" and the side of the plate-shaped member 110 that comes into contact with the platen 41 is referred to as a "rear surface side". Further, the positional relationships in the transport direction of the medium M are referred to as an "upstream side" and a "downstream side".

The plate-shaped member 110 includes a substrate portion 111 that comes into contact with the platen 41, and a medium suppressing portion 114 that covers the end portion of the medium M and keeps the medium M from floating upward from the platen 41. The substrate portion 111 forms a rectangular shape long in the transport direction, and the changing portion 151 is attached to an end portion on the downstream side in the transport direction. The medium suppressing portion 114 projects from one long side of the substrate portion 111 in the width direction (X-axis direction) of the medium M. A corner of the medium suppressing portion 114 on the upstream side includes an inclined surface 123 that inclines obliquely upward (+ side in the Z-axis direction), and guides the end portion of the medium M transported to the downstream side in the transport direction between the medium suppressing portion 114 and the platen 41. The plate-shaped member 110 is formed by punching or bending a metal plate.

The changing portion 151 and the first engaging portion 163 are connected and formed using a same member. Specifically, as illustrated in FIGS. 4 and 5, the changing portion 151 is provided on the front surface side of the substrate portion 111, and the first engaging portion 163 is provided on the rear surface side of the substrate portion 111. The first engaging portion 163 forms a substantially semi-circular shape, and protrudes to the rear surface side from a through hole 164 that has a rectangular shape and pierces through the front and back of the plate-shaped member 110. The changing portion 151, the first engaging portion 163, and the through hole 164 are each provided in pairs and symmetrically formed in relation to the transport direction (Y-axis direction).

The pair of changing portions 151 are turning levers in which base ends are turnably supported on a pair of turning shafts 154 provided on the downstream side of substrate portion 111, and leading ends extend from the turning shafts 154 to the downstream side. The turning shafts 154 are provided between the pair of through holes 164 in the X-axis direction. The changing portion 151 includes a coil spring 152 as an elastic member. Both ends of the coil spring 152 are connected to surfaces on the inner side facing each other near the leading ends of the changing portions 151, and are configured so that the leading ends of the changing portions 151 spread apart from each other in the X-axis direction by an elastic force of the coil spring 152.

On the surface on the outer side of each of the changing portions 151 near the leading end is provided a gripping portion 161 for bringing the leading ends of the changing portions 151 closer to each other in the X-axis direction. The gripping portions 161 are gripped by the user. The first engaging portions 163 are connected between the gripping portions 161 and the base ends of the changing portions 151 via the through holes 164. The first engaging portions 163 are positioned in the substantially X-axis direction relative to the turning shafts 154. The changing portion 151 and the first engaging portion 163 are formed using the same member such as a hard resin. Thus, the configuration can be simplified.

As illustrated in FIGS. 6 and 7, the first engaging portion 163 protrudes from the through hole 164 of the plate-shaped member 110 (substrate portion 111) to the rear surface side, and further projects to one side in the Y-axis direction (– side in the Y-axis direction in the exemplary embodiment). That is, the first engaging portion 163 is formed into an L-shape in a side view from the X-axis direction. The first guide rail 46 forms a groove having an L-shape that follows the first engaging portion 163 in a side view from the X-axis direction. Thus, the first engaging portion 163 is configured to engage with the first guide rail 46 to be slidable in the X-axis direction (width direction of the medium M) and not separable in the Z-axis direction.

The second engaging portion 112 is fixed to the substrate portion 111 of the plate-shaped member 110, protrudes from the substrate portion 111 to the rear surface side, and further projects to both sides in the Y-axis direction (+ side and – side in the Y-axis direction). That is, the second engaging portion 112 forms an inverted T-shape in a side view from the X-axis direction. The second engaging portion 112 includes a contact surface 113 that comes into contact with the second guide rail 44. The contact surface 113 inclined obliquely downward (– side in the Z-axis direction) toward the + side in the Y-axis direction is provided to an upper surface (+ side in the Z-axis direction) of the portion of the second engaging portion 112 that projects to the + side in the Y-axis direction, and has a wedge shape in the side view from the X-axis direction. The second guide rail 44 forms a groove having a substantially inverted T-shape that follows the second engaging portion 112 in a side view from the X-axis direction. Thus, the second engaging portion 112 is configured to engage with the second guide rail 44 to be slidable in the X-axis direction (width direction of the medium M) and not separable in the Z-axis direction.

Further, a space S1 in the transport direction (Y-axis direction) formed between the first engaging portion 163 and the first guide rail 46 is narrower than a space S2 in the transport direction formed between the second engaging portion 112 and the second guide rail 44. The space S1 is preferably as narrow as possible to the extent that allows the first engaging portion 163 to slide relative to the first guide rail 46. When the edge holder 100 is moved in the width direction of the medium M, the first engaging portion 163 slides relative to the first guide rail 46, and thus the second engaging portion 112 does not catch on the second guide rail 44. Note that, the spaces S1, S2 regulate the ranges in which the first engaging portion 163 and the second engaging portion 112 move in the transport direction, respectively.

The changing portion 151 switches the second engaging portion 112 and the second guide rail 44 between a contact state and a separated state by moving the position of the first engaging portion 163 relative to the plate-shaped member 110 in the transport direction (Y-axis direction) and changing the distance between the first engaging portion 163 and the second engaging portion 112.

First, the contact state in which the second engaging portion 112 and the second guide rail 44 are in contact will be described. In a state in which the gripping portions 161 are not gripped by the user, the pair of changing portions 151 are energized to spread apart from each other in the X-axis direction by the elastic force of the coil spring 152. At this time, the changing portions 151 and the first engaging portions 163 connected with the changing portions 151 are urged to rotate in an arc shape about the turning shafts 154. Thus, a force acts on the pair of first engaging portions 163. The force is for moving the pair of first engaging portions 163 to the – side in the Y-axis direction relative to the plate-shaped member 110 while spreading the pair of first engaging portions 163 apart in the X-axis direction. The positions of the first engaging portions 163 in the Y-axis direction are fixed by the first guide rail 46 and the second engaging portions 112 are fixed by the plate-shaped member 110 and thus, in other words, a force for moving the second engaging portions 112 in a direction in which the second engaging portions 112 comes closer (+ side in Y-axis direction) to the first engaging portions 163 is applied. The distance between the first engaging portion 163 and the second engaging portion 112 is changed to a space L1 narrower than a space L2, and thus the contact surface 113 of the second engaging portion 112 and a contact surface 45 of the second guide rail 44 are in a contact state, suppressing movement (sliding) of the edge holder 100 in the X-axis direction relative to the platen 41.

Further, the contact surface 113 of the second engaging portion 112 is inclined obliquely downward toward the + side in the Y-axis direction, and the contact surface 45 of the second guide rail 44 is inclined obliquely upward toward the – side in the Y-axis direction, and thus a force for moving the second engaging portion 112 downward (– side in the Z-axis direction) relative to the platen 41 occurs. That is, the contact surface 113, having a wedge shape, of the second engaging portion 112 is configured to move in the Z-axis direction as well when the second engaging portion 112 is moved in the Y-axis direction. The second engaging portion 112 is fixed to the plate-shaped member 110, and thus a pressing force that presses the platen 41 is applied to the plate-shaped member 110. The contact state is maintained by the elastic force of the coil spring 152 serving as an elastic member, making it possible to continually press the medium M against the platen 41. Thus, it is possible to keep the end portion of the medium M covered by the plate-shaped member 110 from floating upward from the platen 41.

Next, the separated state in which the second engaging portion 112 and the second guide rail 44 are separated will be described. The edge holder 100 is configured to be slidable in accordance with the width of the medium M while guided by the first and second guide rails 46, 44 by operation of the changing portion 151. As illustrated in FIG. 4, when the user wants to move the edge holder 100 relative to the platen 41 in the width direction (X-axis direction) of the medium M, the user grips the pair of gripping portion 161, bringing the leading ends of the changing portions 151 closer to each other in the X-axis direction. Thus, the changing portions 151 then turn in an arc shape about the turning shafts 154. As a result, the first engaging portions 163 connected with the changing portions 151 also rotate in an arc shape about the turning shafts 154, as illustrated in FIG. 5.

The first engaging portions 163 are positioned in the substantially X-axis direction relative to the turning shafts 154, and thus, the pair of first engaging portions 163, with the rotation of the changing portions 151, move in directions approaching each other in the X-axis direction while moving to the + side in the Y-axis direction relative to the plate-shaped member 110. The positions of the first engaging portions 163 in the Y-axis direction are fixed by the first guide rail 46 and the second engaging portions 112 are fixed by the plate-shaped member 110 and thus, in other words, the second engaging portions 112 move in a direction in which the second engaging portions 112 are separated (– side in Y-axis direction) relative to the first engaging portions 163, and the distance between the first engaging portion 163 and the second engaging portion 112 widens from the space L1 in the contact state illustrated in FIG. 6 to the space L2 in the separated state illustrated in FIG. 7. As a result, the contact surface 113 of the second engaging portion 112 and the contact surface 45 of the second guide rail 44 are in a separated state, and the pressing force of the plate-shaped member 110 pressing the platen 41 is released, making it possible to move (slide) the edge holder 100 in the X-axis direction with respect to the platen 41.

When the edge holder 100 is to be slid in the X-axis direction, a force in the X-axis direction is applied in a state where the gripping portions 161 are gripped by the user. The edge holder 100 of the exemplary embodiment is configured so that a distance between the first engaging portion 163 and the changing portion 151 is less than a distance between the second engaging portion 112 and the changing portion 151, and the space S1 between the first engaging portion 163 and the first guide rail 46 is less than the space S2 between the second engaging portion 112 and the second guide rail 44, and thus the edge holder 100 attempts to rotate using the first engaging portion 163 as a fulcrum. Furthermore, the edge holder 100 is configured so that the first engaging portion 163 and the changing portion 151 that includes the gripping portion 161 that serves as a force point for rotating the edge holder 100 are connected by the same member, decreasing the distance between the first engaging portion 163 and changing portion 151. Thus, the rotation of the edge holder 100 is suppressed, making it possible to smoothly slide the edge holder 100 in the X-axis direction.

As described above, according to the printing apparatus 11 of the exemplary embodiment, the following advantages can be achieved.

The printing apparatus 11 of the exemplary embodiment includes the platen 41 including the first and second guide rails 46, 44, and the edge holder 100 including the plate-shaped member 110 that covers the end portion of the medium M, and the first and second engaging portions 163, 112 that engage with the first and second guide rails 46, 44. When the edge holder 100 is slid in the width direction of the medium M, the space S1 between the first guide rail 46 and the first engaging portion 163 serving as a fulcrum for rotating edge holder 100 is narrower than the space S2 between the second guide rail 44 and the second engaging portion 112, decreasing the distance between the first engaging portion 163 and the gripping portion 161 of the changing portion 151 serving as a force point that rotates the edge holder 100. When the edge holder 100 is moved in the width direction of the medium M, the first engaging portion 163 slides relative to the first guide rail 46, and thus the second engaging portion 112 does not catch on the second guide rail 44. Further, the distance between the fulcrum and the force point is short, suppressing rotation of the edge holder 100 and making it possible to smoothly slide the edge holder 100 in the width direction of the medium M.

In the changing portion 151, the distance between the first engaging portion 163 and the second engaging portion 112 changes to the space L1, which is narrower than the space L2. Thus, the contact surface 113 of the second engaging portion 112 and the contact surface 45 of the second guide rail 44 are in a contact state, suppressing movement (sliding) of the edge holder 100 in the X-axis direction relative to the platen 41. Further, in the changing portion 151, the distance between the first engaging portion 163 and the second engaging portion 112 changes to the space L2, which is wider than the space L1. As a result, the contact surface 113 of the second engaging portion 112 and the contact surface 45 of the second guide rail 44 are in a separated state, and the pressing force of the plate-shaped member 110 pressing the platen 41 is released, making it possible to move (slide) the edge holder 100 in the X-axis direction with respect to the platen 41.

The changing portion 151 and the first engaging portion 163 are connected using the same member. When the edge holder 100 is slid in the width direction of the medium M, the distance between the first engaging portion 163 serving as a fulcrum for rotating the edge holder 100, and the gripping portion 161 of the changing portion 151 serving as a force point that rotates the edge holder 100 also decreases. Thus, rotation of the edge holder 100 is further suppressed, making it possible to smoothly slide the edge holder. Further, the changing portion 151 and the first engaging portion 163 are formed using the same member, making it possible to simplify the configuration.

The contact surface 113 of the second engaging portion 112 that comes into contact with the second guide rail 44 has a wedge shape, and thus a force for moving the second engaging portion 112 downward relative to the platen 41 occurs. The second engaging portion 112 is fixed to the plate-shaped member 110, and thus a pressing force that presses the platen 41 is applied to the plate-shaped member 110. Thus, it is possible to suppress the end portion of the medium M covered by the plate-shaped member 110 from floating upward from the platen 41.

The changing portion 151 includes the coil spring 152 as an elastic member. The contact state between the second engaging portion 112 and the second guide rail 44 is maintained by the elastic force of the coil spring 152, making it possible to continually press the medium M against the platen 41.

Note that the present invention is not limited to the above-described exemplary embodiments, and various modifications and improvements can be made to the above-described exemplary embodiments. Such modifications are described below. Note that the same constituents as those in exemplary embodiment are given the same reference signs, and redundant description of these constituents will be omitted.

Modified Example 1

Figure 8:
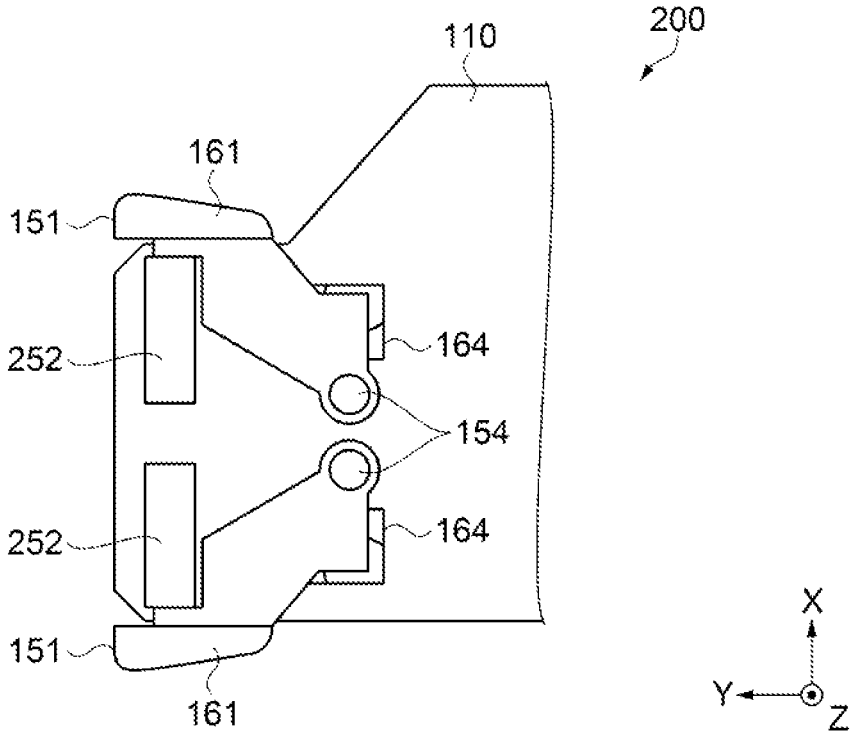
FIG. 8 is a plan view illustrating a configuration of the changing portion in the edge holder according to Modified Example 1.

FIG. 8 is a plan view illustrating a configuration of the changing portion in the edge holder according to Modified Example 1. The configuration of an edge holder 200 according to the modified example will be described with reference to FIG. 8. Note that, in FIG. 8, the cover member 153 configured to cover a portion of a changing portion 151 is illustrated as if transparent.

The changing portions 151 of the edge holder 200 each include a magnet 252. The magnets 252 are provided on the surfaces on the inner sides of each of the changing portions 151 facing each other, near the leading ends of the changing portions 151. The magnets 252 are configured so that the same poles are disposed facing each other, and the leading ends of the changing portions 151 are spread apart from each other in the X-axis direction by a repelling force (magnetic force) of the magnets 252. Thus, the contact state between the second engaging portion 112 and the second guide rail 44 is maintained, making it possible to continually press the medium M against the platen 41.

Modified Example 2

Figure 9:
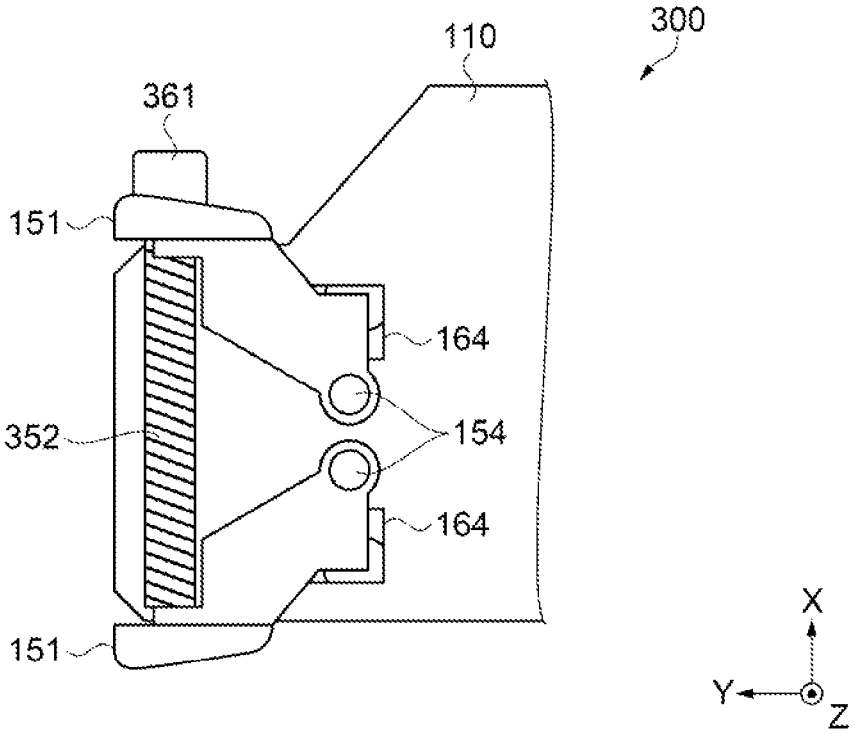
FIG. 9 is a plan view illustrating a configuration of the changing portion in the edge holder according to Modified Example 2.

FIG. 9 is a plan view illustrating the configuration of the changing portion in the edge holder according to Modified Example 2. The configuration of an edge holder 300 according to the modified example will be described with reference to FIG. 9. Note that, in FIG. 9, the cover member 153 configured to cover a portion of a changing portion 151 is illustrated as if transparent.

The changing portions 151 of the edge holder 300 include a screw (bolt) 352 and a motor 361. Both ends of the screw 352 are connected to the surfaces on the inner side facing each other, near the leading ends of the changing portions 151. The motor 361 that rotationally drives the screw 352 is provided on one end of the screw 352. The motor 361 is configured to open and close the leading ends of the pair of changing portions 151 in the X-axis direction when driven in the forward and reverse directions. Thus, the second engaging portion 112 and the second guide rail 44 can be switched between the contact state and the separated state.

Further, the contact state between the second engaging portion 112 and the second guide rail 44 is maintained by driving the motor 361 in a direction in which the leading ends of the pair of changing portions 151 open (spread apart from each other) in the X-axis direction. Thus, it is possible to continually press the medium M against the platen 41.

Note that while a changing portion in which the screw 352 is rotated by the motor 361 is described in the modified example, the pair of changing portions 151 may be connected by a wing bolt instead of the screw 352 and the motor 361. The pair of changing portions 151 can be opened and closed, switching the second engaging portion 112 and the second guide rail 44 between the contact state and the separated state, by the user turning the wing bolt. Further, with the contact state thus maintained, it is possible to continually press the medium M against the platen 41.

This application claims priority under 35 U.S.C. § 119 to Japanese Patent Application No. 2017-245965, filed Dec. 22, 2017. The entire disclosure of Japanese Patent Application No. 2017-245965 is hereby incorporated herein by reference.

What is claimed is:

1. A printing apparatus comprising:

a platen including a first guide rail and a second guide rail mutually parallel in a width direction that intersects a transport direction of a medium;

an edge holder including a plate-shaped member configured to cover an end portion of the medium in the width direction, a first engaging portion configured to engage with the first guide rail, and a second engaging portion configured to engage with the second guide rail; and a changing portion that is provided on the first engaging portion side and is for changing a position of the plate-shaped member in the width direction, wherein a space in the transport direction formed between the first engaging portion and the first guide rail is narrower than a space in the transport direction formed between the second engaging portion and the second guide rail.

2. The printing apparatus according to claim 1, wherein the changing portion is configured to switch the second engaging portion and the second guide rail between a contact state and a separated state by moving a position of the first engaging portion relative to the plate-shaped member in the transport direction, and changing a distance between the first engaging portion and the second engaging portion.

3. The printing apparatus according to claim 1, wherein the changing portion and the first engaging portion are connected and formed using a same member.

4. The printing apparatus according to claim 2, wherein the second engaging portion that comes into contact with the second guide rail has a wedge shape.

5. The printing apparatus according to claim 2, wherein the changing portion includes an elastic member, and the contact state is maintained by an elastic force of the elastic member.

6. The printing apparatus according to claim 2, wherein the changing portion includes a magnet, and the contact state is maintained by a magnetic force of the magnet.

7. The printing apparatus according to claim 2, wherein the changing portion includes a screw, and the contact state is maintained by the screw.

8. The printing apparatus according to claim 2, wherein the changing portion includes a motor, and the contact state is maintained by a driving force of the motor.

* * * * *